US005892442A

United States Patent [19]

Ozery

[11] Patent Number: 5,892,442

[45] Date of Patent: Apr. 6, 1999

[54] TWO-WAY PAGER ALARM SYSTEM

[76] Inventor: Nissim Ozery, 1740 NW. 107 Dr., Coral Springs, Fla. 33071

[21] Appl. No.: 790,386

[22] Filed: Jan. 29, 1997

[51] Int. Cl.[6] ..... G08B 1/08

[52] U.S. Cl. ..... 340/539; 340/506; 340/531; 340/825.72; 455/53.1

[58] Field of Search ..... 340/539, 506, 340/531, 534, 825.06, 311.1, 825.44, 825.72; 455/53.1, 67.1, 70; 379/45

[56] References Cited

U.S. PATENT DOCUMENTS

| | | | |
|---|---|---|---|
| 3,969,709 | 7/1976 | Isaacs | 340/339 |
| 4,908,600 | 3/1990 | Martinez | 455/75 |
| 4,994,787 | 2/1991 | Kratt | 340/505 |
| 5,128,979 | 7/1992 | Reich | 379/40 |
| 5,278,539 | 1/1994 | Lauterbach | 379/40 |
| 5,319,698 | 6/1994 | Glidewell | 340/539 |
| 5,486,812 | 1/1996 | Todd | 340/539 |

*Primary Examiner*—Jeffery A. Hofsass
*Assistant Examiner*—Daryl C. Pope
*Attorney, Agent, or Firm*—McHale & Slavin, P.A.

[57] ABSTRACT

A two-way pager alarm system for a home or business that reports to a security monitoring center in a wireless fashion. The alarm system, when required, initiates communication with the security monitoring center through the existing base station network that supports the two-way pager's communication, thereby transferring an alarm condition message to a distant security monitoring center with minimal transmission power. The message to the security monitoring center contains an individualized code which identifies the owner of the alarm system and also contains additional information, such as the alarm condition. The communication between the alarm system and the security monitoring center is based upon a two-way paging protocol such as ReFlex™. At the security monitoring center the message is received and translated by a computer into specific information pertaining to the alarm system. The two-way pager technology can be incorporated into new or existing alarm systems, and can replace and/or augment other alarm communication methods.

4 Claims, 4 Drawing Sheets

TWO-WAY PAGER ALARM SYSTEM

FIELD OF INVENTION

This invention relates to a reporting alarm system which utilizes two-way pager technology to provide a bi-directional or two-way link between an alarm system station and a security monitoring center.

BACKGROUND OF THE INVENTION

Electronic alarm systems have existed for many years which utilize a series of sensors linked to a centralized sensor station. Such sensors might include magnetic or electronic switches which are installed across doors or windows in a home or business. Other sensors might include level or event detectors which provide a signal based upon a predetermined alarm condition. The sensors can be connected or linked to the receiving station in a variety of ways, including hardwired or wireless connections. Wireless connections are often used to eliminate the need for unsightly or difficult to install wiring harnesses during installation. For instance, U.S. Pat. No. 3,969,709 discloses a wireless burglar alarm system which utilizes a remote transmitter to send a high frequency carrier signal, which is indicative of an alarm condition, to a receiver to sound an alarm. U.S. Pat. No. 5,486,812 discloses a similar security arrangement with a control module, an alarm, and a multiplicity of stations. Each station incorporates a detector and a transmitter for sending alarm condition signals to the control module which then indicates an alarm condition. Accordingly, these disclosures alleviate the time and expense required for hardwiring alarm transmitters and receiver units throughout a building or structure for a given alarm system.

Alternatively, the central sensor station can be used to collect and process the various alarm signals and can thereafter be used to communicate the alarm conditions to the necessary security monitoring center and/or authorities so that appropriate corrective action can be taken. The sensor station signals are transmitted to the security monitoring center via hardwired (e.g. telephone) or wireless (e.g. radio frequency) connections. U.S. Pat. No. 5,319,698 discloses an example of one such system which uses a slave transmitter to provide a signal to a local security station. The security station activates an alarm and/or dials a sequence of telephone numbers to provide a verbal alarm. Another example is shown in U.S. Pat. No. 4,994,787 which discloses an on location base station which latches alarm conditions and retains them until manually reset. A remote station is then used to interrogate the base station to determine whether an alarm has occurred.

In either example system, the transmitter must be powerful enough, or the receiver near enough, so that the signals are received by the security monitoring center. Standard RF transmissions are limited in power and range by the practicality of the system, and Federal laws regulate the transmission of such signals through the air. Lower powered transmitters might be used if a relay system where employed to sequentially boost and re-transmit the alarm signal to the destination security monitoring center. However, such a transmission relay system would be very expensive to construct and maintain.

Alternatively still, many alarm systems do not use wireless signal transmissions and instead communicate with the security monitoring center via telephone line. While this is an inexpensive way to transmit alarm signals over long distances, the telephone connections are susceptible to breakage and sabotage. For instance, a burglar might become familiar with a particular system's usage of phone lines to report alarm conditions and therefore cut the outgoing telephone line. The burglar would then be free to trip the alarm and rob the now unprotected building or structure because the alarm system would have lost its link to the security monitoring center.

As a result, telephone companies are currently forced to use expensive dedicated electronic equipment to monitor telephone lines that are being used for alarm reporting systems. Such hardware monitors the telephone lines relatively frequently, e.g. usually every 15 seconds, to alert the security monitoring center in case of a break or malfunction in the line. The need for such monitoring hardware is further necessitated by the fact that most houses have the telephone line exposed at the point where it enters the external wall of the house and therefore it is easy for a burglar to cut the line before breaking into the dwelling.

The Applicant submits that two-way pager technology might be used for the transmission link between the sensor station and the security monitoring center which would utilize relatively low power, but would still provide effective range. However, the prior art does not presently teach such a solution for alarm systems. U.S. Pat. No. 5,128,979 discloses a personal emergency response system which includes a local response center which pages on-site personnel via individual paging units in response to alarm signals. U.S. Pat. No. 5,278,539 discloses an emergency warning system which utilizes conventional RF or telephonic links between sensor stations and the security monitoring station (Local Emergency Planning Commission—LEPC). The LEPC then sends out various signals via pager transmissions to receiving media locations to thereby initiate warnings to the public. These systems, however, do not teach the implementation and advantages of two-way paging technology as applied to the communication link between the sensor station and security monitoring center.

Accordingly, what is needed in the field is an alarm system which incorporates a communication means between the centralized sensor station and the security monitoring center which is wireless, capable of two-way communication, and yet can transmit a signal over a relatively long distance while using a relatively low-powered transmitter.

SUMMARY OF THE INVENTION

The present invention provides a reporting alarm system which utilizes a two-way paging device to communicate between a centralized sensor station and a security monitoring center. A building or structure incorporates a series of sensors or detectors for indicating alarm conditions such as smoke, motion, or flooding. These sensors are connected, via hardwiring or wireless connections as desired, to a centralized sensing station. The sensing station collects and processes various alarm conditions and transmits the results to a security monitoring center at a remote location via the paging device. Upon receipt of the alarm condition, the security monitoring center can transmit messages back to the sensing station. Such messages might include a corrective signal and/or instructions to discontinue further alarm condition transmissions.

Accordingly, an existing low-cost transmission network can be utilized which does not rely on phone lines. Each subscriber to the system is assigned an unique code which allows multiple users throughout the security monitoring system. The sensing station can thereby operate effectively, even while using a relatively low transmission power output, because the pager network will intercept and relay the transmitted signal as appropriate. Whereas prior paging technology only allowed for one-way paging, the two-way pager allows transmissions to be sent in both directions between the sensing station and the security monitoring center. Known communication protocols and data structures can be used to facilitate the organization and transmission of messages. The present invention can be applied to existing alarm systems, or can be implemented independently, as described below. The present invention can also serve to replace and/or augment the communication medium between the sensor station and the security monitoring center.

The two-pager device and related transmission protocol might include any of several systems currently available on the market. For example, Motorola's Advanced Messaging Systems Division (AMSD) and Destineer Corporation, which is a subsidiary of Mobile Telecommunication Technologies Corp. (Mtel) announced that Motorola is providing Destineer with messaging equipment for a nationwide ReFlex™ system which is a new high speed transport protocol. Wireless Access Corporation developed a SERIES 6000™ chipset for two-way paging applications. This chipset can be used by a product developer to design products for narrow pager communication system (PCS) networks already in operation, as well as new networks presently being developed and built. The two-way paging solution provides a wireless solution as an integral part of the alarm system located inside the home/business. The wireless link, and its associated hardware located within the protected structure, are not easily compromised by a burglar or saboteur.

Thus an object of the present invention to provide an alarm system for reporting alarm conditions between a sensing station and a remotely located security monitoring center with alarm condition signals sent via a two-way paging device incorporated into the alarm system.

It is yet another object of the present invention to provide an alarm system which eliminates the need to monitor phone lines in order to insure their integrity.

It is still another object of the present invention to provide a wireless two-way pager communication device which can be incorporated into an new alarm system, or added to an alarm system that is already in operation.

It is still a further object of the present invention to provide an alarm system which utilizes a two-way paging device based upon the SERIES 6000™ chipset and ReFlex™ related communication protocol.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
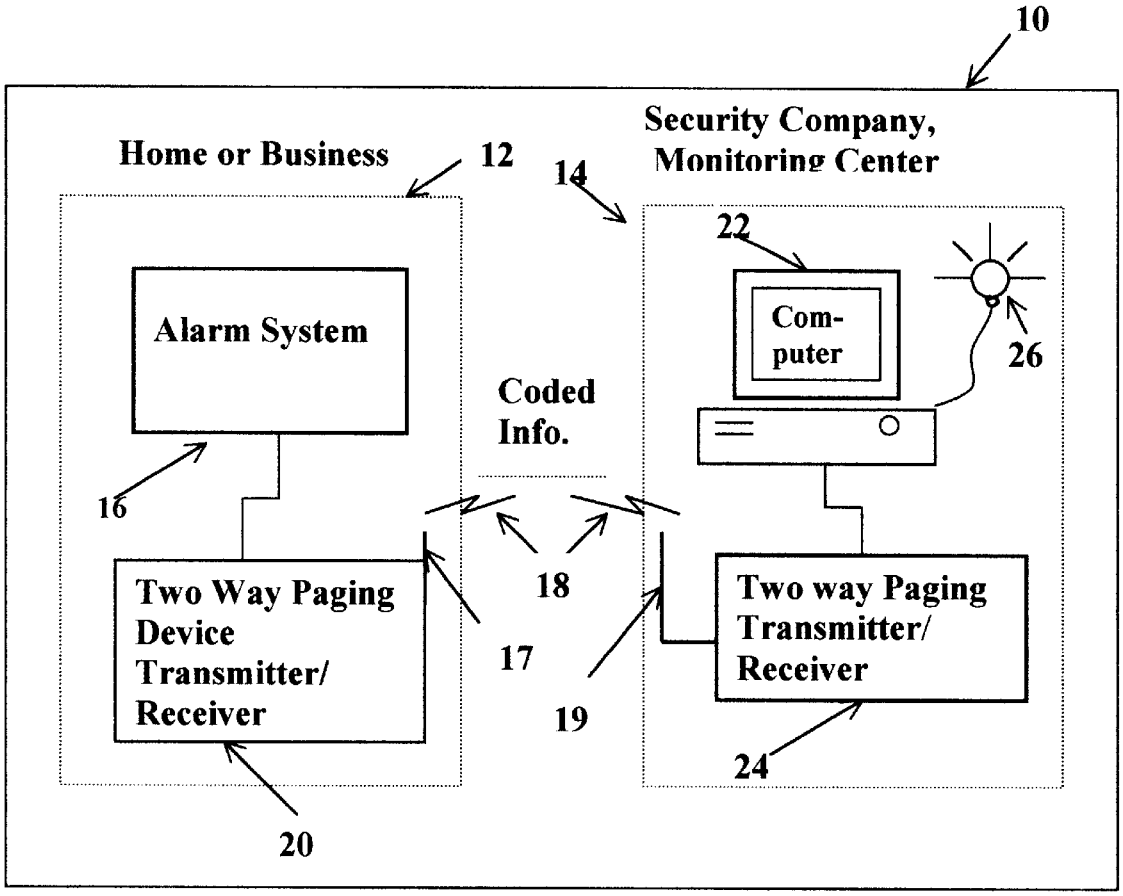
FIG. 1 is a block diagram of an alarm system utilizing the two-way paging device to communicate between a home or business to be protected and a security company monitoring center.

Referring now to FIG. 1, a block diagram is shown of the present invention 10 with a home/business 12 linked via a wireless two-way pager connection 18 to a security company monitoring center 14. The home/business 12 is protected by an alarm system 16 which incorporates the two-way paging device 20 and a transmitter/receiver 12 which is connected to the alarm system 16. The security company monitoring center 14 utilizes a computer 22 coupled to a similar two-way paging transmitter/receiver 24. A series of coded transmissions 18 emanate from the respective antennas 17 and 19 which are connected to the two-way paging devices 20 and 24. When coded transmissions 18 are received which indicate an alarm condition, a visual or audible alarm 26 is triggered. As described above, the two-way pager might include hardware and related communication protocol software from any of a variety of manufacturers. The example embodiment presented herein utilizes the SERIES 6000™ chipset and associated ReFlex™ communication protocol for its functionality.

Figure 2:
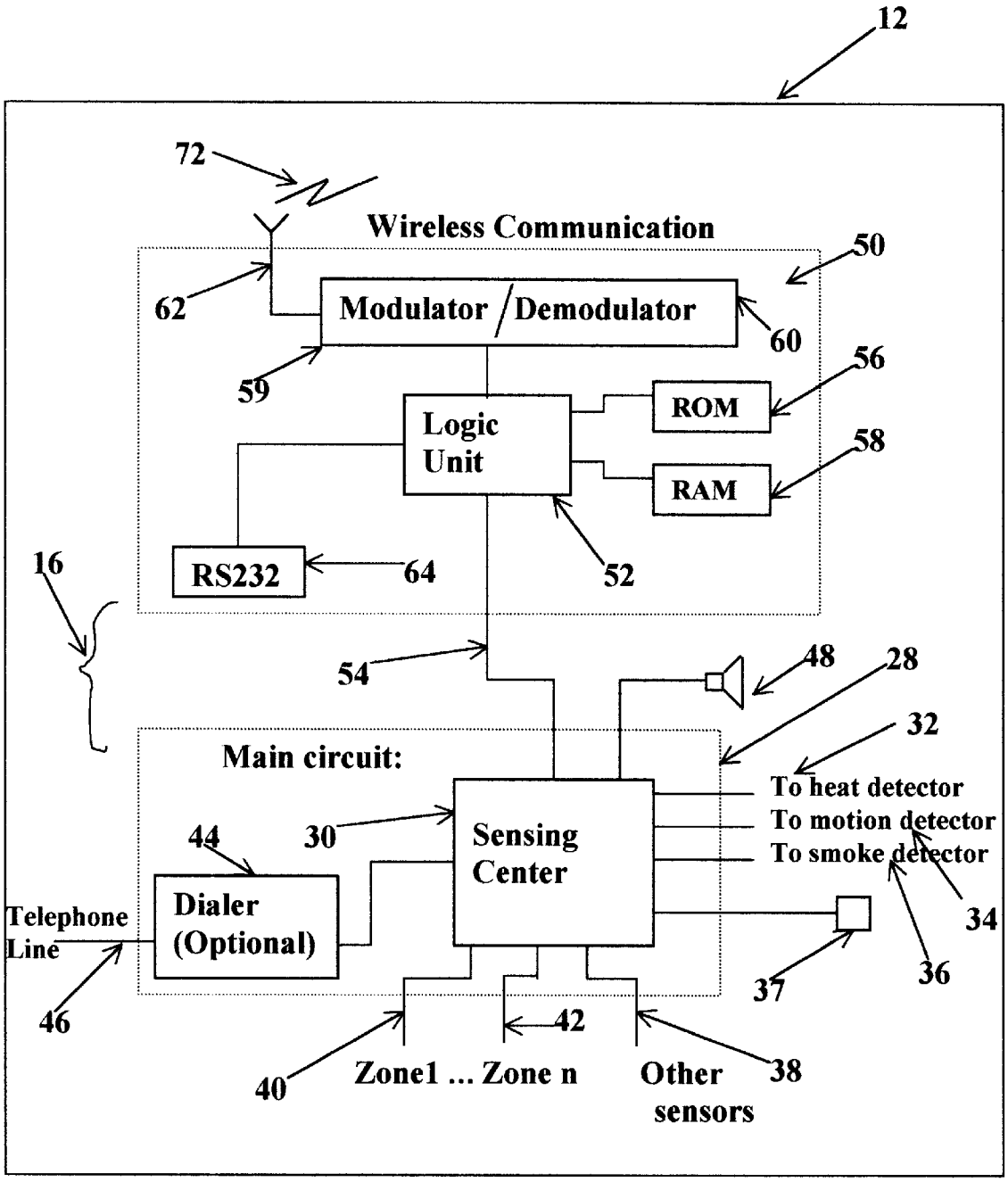
FIG. 2 is a block diagram of an alarm system with sensors connected to a sensing center and which incorporates a wireless two-way pager communication circuit.

Referring also now to FIG. 2, a more detailed block diagram of the home/business 12 is shown. A main circuit 28 is shown which includes a sensing center 30. The sensing center 30 has connections leading to various sensors and detectors including for example a heat detector 32, a motion detector 34, and a smoke detector 36. Connections to other sensors 38 are included as needed for the particular application or alarm situation. Also shown are a series of zone connections for indicating an alarm condition in zone 1 (element 40) through zone n (element 42). Such zone sensors 40–42 might include magnetic switches across various windows and/or doors of a home/business. A keypad 37 might also be connected to provide manual alarm inputs for testing and/or configuration of the alarm system. The connections 32–42 shown might be hardwired or wireless depending up the needs of the user. The main circuit 28 also includes an optional dialer 44, or modem device, connected to the sensing center 30. The dialer 44 can be used to access and provide information over a telephone line 46 regarding various alarm conditions. A user or owner of the system 12 might also use the line to access and reconfigure the alarm system as needed. The sensing center also includes a localized alarm indicator or device 48 to provide warnings to authorized personnel at the home/business, and additionally serves to frighten and drive away unauthorized intruders.

The home/business 12 additionally includes a wireless communication circuit 50 which allows the main circuit 28 of the alarm system 16 to report to the security monitoring center 14. The wireless communication circuit 50 includes a logic unit 52 which is connected via 54 to the sensing center 30. This logic unit would typically consist of a microprocessor. The circuit 50 also includes a Read Only Memory (ROM) 56 and a Random Access Memory (RAM) 58 connected to the logic unit 52. The circuit 50 further includes a modulator and demodulator unit 59, 60 and an associated antenna 62 which provides pager signal transmissions to and from the circuit 50. An RS232 or other similar port 64 provides an additional communication input/output for interfacing with the logic unit 52. The RS232 port 64 would typically be used to load the subscriber's unique code into the RAM before the installation of the alarm system at a particular location to be protected.

When an event triggers the sensing center 30 of the alarm system 16, the sensing center 30 sends a signal to the logic unit 52 of the wireless communication circuit 50. The signal contains data as to the source of the alarm, e.g. the heat sensor, smoke detector, motion detector, zone number or keypad 32–42. The receipt of a signal triggers the logic unit 52 to start the reporting process via the wireless two-way pager circuitry depicted generally by circuit 50. Each subscriber to a security monitoring system has an individual identification code assigned. The logic unit 52 loads the subscriber's unique code from RAM 58 and loads the communication protocol from the ROM 56.

Figure 3:
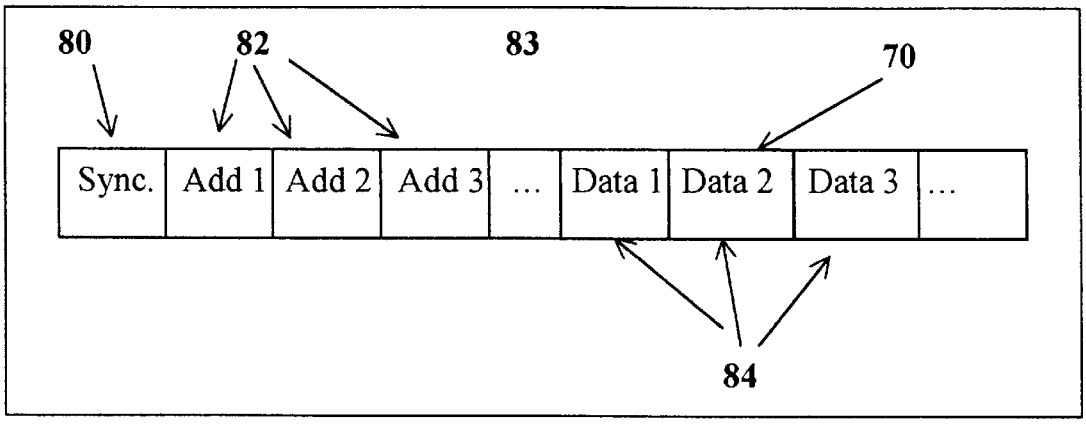
FIG. 3 is an example data stream for a communication protocol.
Figure 4:
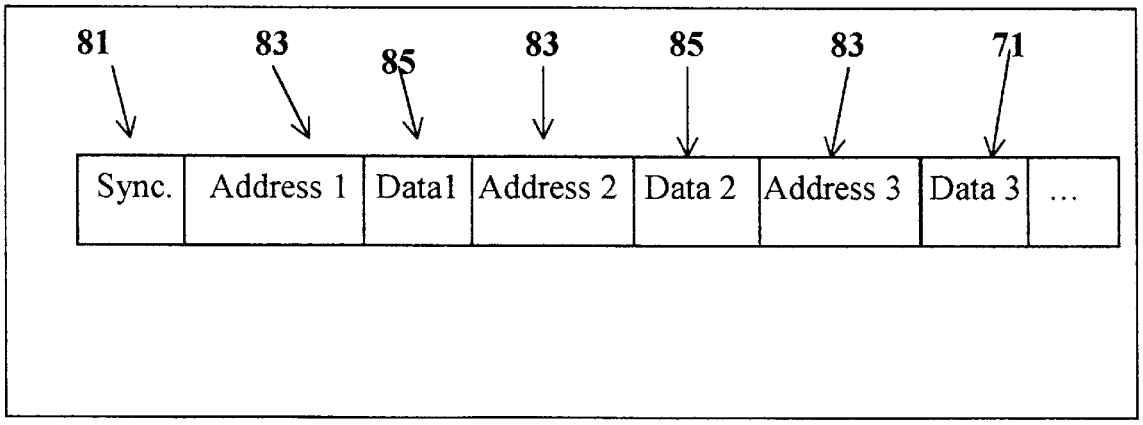
FIG. 4 is another example data stream for a communication protocol.

Referring also now to FIG. 3, an example data stream is shown for an example communication protocol 70. This data stream uses sync bits 80, address bits 82, and corresponding data bits 84 occurring in sequence. FIG. 4 shows yet another data stream for an example communication protocol 71. This data stream uses sync bits 81, and address bits 83 which alternative with the corresponding data bits 85.

While any such protocol might be used, the pager message is created by incorporating the subscriber's information with the data received from the alarm sensing center into the appropriate communication protocol format. The logic unit 52 transfers the communication protocol with this combined information to the modulator 59 to thereby modulate the data and transmit it through the air. The transmission 72 is received and relayed by the series of base stations (not shown) which comprise the pager network of the pager service provider. The message is eventually relayed to the security monitoring center 14. As each subscriber will have an unique identity code, the receipt of a message will indicate an alarm condition at a particular location. The user's unique code can then be translated into more specific information such as the name and address of that particular subscriber and sent to the appropriate authorities such as the fire department or the police.

The security monitoring center 14 then has the option of sending back a confirmation or other type of message to the alarm system 16. Accordingly, the demodulator 60 is used to demodulate incoming signals from the security monitoring center 14. Such return messages can be used for confirmation signals to provide feedback to the alarm system that the alarm signal has been received and is being acted upon. The security monitoring center 14 can also send signals to invoke maintenance functions or check of the functionality of the alarm system 16.

Figure 5:
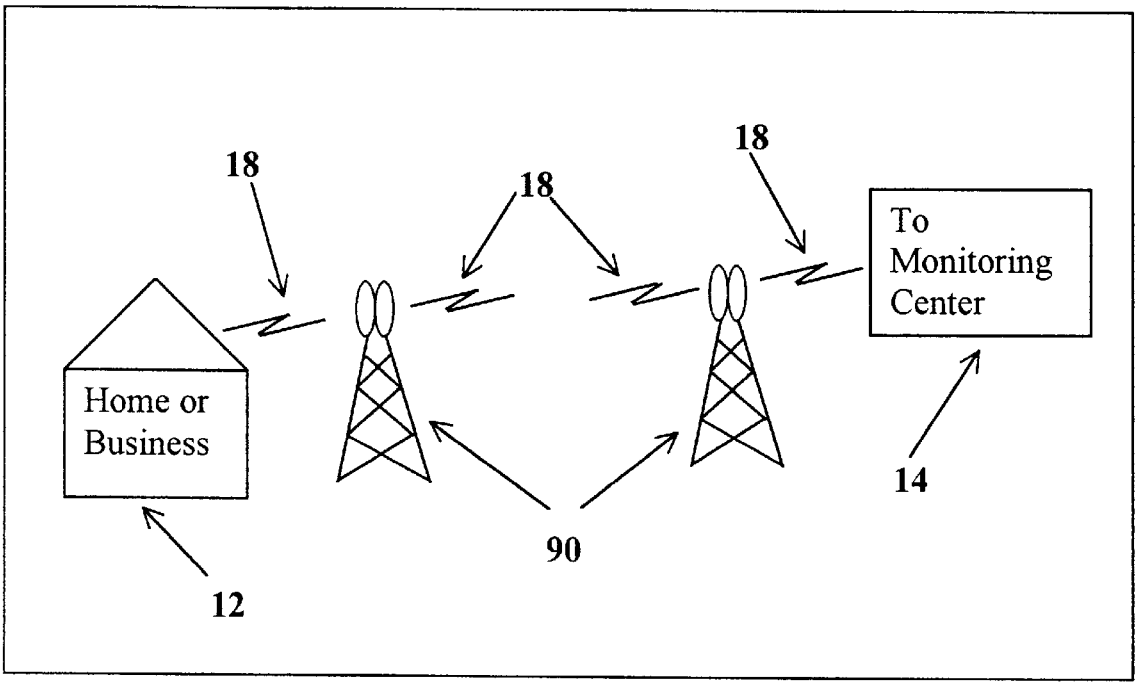
FIG. 5 is a diagram showing the generalized transmission relay sequence.

Referring now to FIG. 5, a diagram of the generalized transmission relay sequence is shown. The home or business 12 is shown sending a coded transmission 18 which is relayed by the antennas 90 comprising a pager network. The transmission 18 is then received, processed, and replied to by the monitoring center 14, as described above, through the same pager network.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. An alarm system which provides a two-way wireless communication link between a centralized sensing station and a remote security monitoring center, said alarm system comprising:

at least one sensor means for detecting an alarm condition event and providing an alarm condition signal;

a sensing center means for receiving and processing said alarm condition signal;

a wireless communication circuit means connected to said sensing center means for transmitting and receiving in real time alarm condition information over a two-way pager network utilizing two-way pager communication protocols wherein said wireless communication circuit means includes a logic unit connected to a read only memory (ROM) means and a random access memory (RAM) means, said ROM means storing communication protocol data and said RAM means storing an identification code unique to said alarm system, said logic unit reading said protocol data and said identification code and immediately forming a transmission message based upon said alarm condition information and said identification code to process a message and to initiate transmission;

a security monitoring center means for transmitting and receiving reported alarm condition information over the two-way pager network utilizing the two-way pager communication protocols said monitoring center replying or interrogating a specific cite using the same single bandwidth.

2. The alarm system of claim 1, wherein said wireless communication circuit means includes a modulator unit and a demodulator unit connected to said logic unit, said modulator unit modulating said transmission message for two-way pager network transmission in real time.

3. The alarm system of claim 1, wherein said logic unit includes a data port for transferring data to said wireless communication circuit before installation.

4. The alarm system of claim 1, wherein said security monitoring center means includes a computer for processing alarm condition signals and returning notification messages.

* * * * *